US005699679A

United States Patent [19]

Wu et al.

[11] Patent Number: 5,699,679

[45] Date of Patent: Dec. 23, 1997

[54] CRYOGENIC AEROSOL SEPARATOR

[75] Inventors: Jin Jwang Wu, Ossining; William Albert Cavaliere, Verbank; James Patrick Norum, Millwood; Stefan Schmitz, Pleasant Valley, all of N.Y.

[73] Assignee: International Business Machines Corporation, Armonk, N.Y.

[21] Appl. No.: 691,702

[22] Filed: Jul. 31, 1996

[51] Int. Cl.[6] ..... F25J 1/00

[52] U.S. Cl. ..... 62/617; 62/52.1; 134/7

[58] Field of Search ..... 62/617, 51.1, 52.1; 134/7

[56] References Cited

U.S. PATENT DOCUMENTS

| | | | |
|---|---|---|---|
| 4,292,050 | 9/1981 | Linhardt et al. | 55/1 |
| 4,469,497 | 9/1984 | Linhardt | 55/282 |
| 4,994,097 | 2/1991 | Brouwers | 55/317 |
| 5,062,898 | 11/1991 | McDermott et al. | 134/7 |
| 5,073,177 | 12/1991 | Brouwers | 55/317 |
| 5,145,113 | 9/1992 | Burwell et al. | 239/102.2 |
| 5,152,457 | 10/1992 | Burwell et al. | 239/102.2 |
| 5,209,028 | 5/1993 | McDermott et al. | 51/426 |
| 5,279,736 | 1/1994 | Moorhead | 210/383 |
| 5,294,261 | 3/1994 | McDermott et al. | 134/7 |
| 5,366,156 | 11/1994 | Bauer et al. | 239/135 |
| 5,426,944 | 6/1995 | Li et al. | 62/617 |

*Primary Examiner*—Ronald C. Capossela
*Attorney, Agent, or Firm*—H. Daniel Schnurmann

[57] ABSTRACT

A cryogenic aerosol separator/classifier for separating and selectively removing particles from a stream of aerosol. The aerosol stream is produced by a cryogenic aerosol generator comprising a reservoir containing a cryogenic gas-liquid mixture at a first pressure, a delivery line coupled to the reservoir, and a nozzle. The nozzle has at least one exit opening which allows the cryogenic gas-liquid mixture to expand from the first pressure to a lower pressure and, thus, to produce cryogenic aerosol. A separator is coupled to the nozzle, such that the light particles having high mobility are removed from the stream, thereby producing a stream of cryogenic flow with particles having a controlled size to clean a contaminated surface. The apparatus is enhanced by utilizing a magnetic field and/or specially designed flow fields to fully take advantage of the enhanced mobilities of light particles.

29 Claims, 6 Drawing Sheets

CRYOGENIC AEROSOL SEPARATOR

CRYOGENIC AEROSOL GENERATOR

CRYOGENIC AEROSOL SEPARATOR

ENHANCED CRYOGENIC AEROSOL SEPARATOR

CRYOGENIC AEROSOL SEPARATOR

FIELD OF THE INVENTION

The present invention is related generally to a cryogenic aerosol apparatus and, more particularly, to an aerosol separator for inertially separating and classifying particles from a stream of aerosol.

BACKGROUND OF THE INVENTION

Cryogenic aerosol apparatus using carbon dioxide, argon, and nitrogen have proven to be highly effective in removing particles and residues from a surface. They have found wide applications in many industries, such as microelectronics, aerospace, and the like.

Cryogenic aerosol is created when a relatively high pressure cryogenic gas-liquid mixture is allowed to rapidly expand into a region of lower pressure. During the expansion, the mixture cools and solidifies. Cryogenic aerosol stream formed during this process typically includes particles having a wide range of size distribution. Oftentimes, it is advantageous to select particles of a given size or mass range from the heterogeneous matter contained in the gas stream to accommodate a given application. For some applications, certain particles may cause damage to the surface upon which the stream of particles is being directed to; in others, the particles may be of such size and mass that they may not be effectively used.

An example of an aerosol apparatus is described in U.S. Pat. No. 5,366,156, issued on Nov. 22, 1994 to Bauer et al., and of common assignee. This patent discloses a nozzle connected to a delivery line that receives the substance from the delivery line. The nozzle is provided with an exit opening which allows the substance to pass through and to expand from a high pressure to a lower pressure, which solidifies the substance and produces aerosol. All the particles formed during the expansion are used to interact with the surfaces. When the high velocity aerosol spray, formed through an expansion nozzle 30, as shown in FIG. 1, is directed towards a surface 20, the collision of frozen particles 10 in the stream with surface contaminants imparts sufficient energy to dislodge them. Aerosol particles within the gas jet stream are propelled against the surface and remove organic films, ionic impurities, and the like.

U.S. Pat. No. 5,062,898, issued November 5, 1991, to McDermott et al., discloses a method of effectively cleaning a surface using a cryogenic aerosol of a similar type, wherein contaminated particles and/or films are removed by a stream of argon aerosol particles. The stream is oftentimes enhanced to include a nitrogen carrier, such that the nitrogen remains in the gaseous state after the expansion that forms an argon aerosol particle stream.

During cleaning, the temperature at the surface drops quickly to a cryogenic temperature due to the interaction with the cold solid-gas mixture. Contact or radiation heating have been successfully used to maintain the temperature of the surface being cleaned in order to avoid adverse effects associated with temperature reduction, such as moisture condensation on the surface under consideration. By way of example, U.S. Pat. No. 5,209,028, issued May 11, 1993, to McDermott et al., relates to an apparatus for cleaning semiconductor solid surfaces using a cryogenic aerosol that impinges on the surface and removes contaminants thereon. Of particular interest is the ability of the apparatus to provide a controlled atmosphere which dispenses a spray of sublimated frozen particles for cleaning. Tracking means are added to administer the cleaning in a calibrated manner.

Other patents related to cryogenic aerosols include U.S. Pat. No. 5,366,156 issued to Bauer et al.; U.S. Pat. No. 5,062,898, U.S. Pat. No. 5,294,261, and U.S. Pat. No. 5,209,028all issued to McDermott et al.

When a cryogenic aerosol is used to remove contaminants from the surface of, e.g., a semiconductor substrate, the low temperature (normally, in the range of −190° F to −300° F) of the stream causes the substrate to become brittle. Damage is seen on the delicate structures contained on and/or within the substrate. Solutions for maintaining the surface at a higher temperature by utilizing radiation and/or contact heating are oftentimes neither desirable nor practical. This is particularly true in the presence of miniature devices, e.g., optical fibers, typically having a diameter in the range of 100–200 μm., or a wire-bonded chip, commonly less than 1" or 2" in size, and whose dimension and/or configuration precludes the use of these solutions.

Similarly, other types of delicate structures may be damaged as the result of other causes, such as turbulence produced near the substrate surface due to vaporization of cryogenic clusters at the surface interaction. This may cause the actual breakage of a membrane type substrate. The breakage is seen in applications such as cleaning x-ray lithography masks and the like, wherein clusters, i.e., groups of gas molecules and/or particle precursors, often vaporize during the interaction with the substrate.

OBJECTS OF THE INVENTION

Accordingly, an object of the present invention is to provide a cryogenic aerosol with a separator and/or classifier to preclude the formation of clusters and the presence of light cryogenic particles in a jet stream, in order to minimize the temperature cooling on the surface of a substrate and the presence of turbulence created by the jet stream of the cryogenic aerosol.

Another object of the present invention is to inertially remove selected particles from the main gas jet stream.

A further object of the present invention to evacuate the clusters and/or light cryogenic particles from the jet stream to eliminate a build-up of gas on the surface to be cleaned, thereby avoiding potential damage.

SUMMARY OF THE INVENTION

Generally, the present invention relates an apparatus for separating cryogenic clusters and/or light particles (i.e., having high mobility) from large particles within the aerosol stream.

The invention further relates to a cryogenic aerosol classifier and separator for removing particles of a predetermined size from the aerosol stream.

The apparatus includes a cryogenic aerosol generator comprising: a reservoir containing a cryogenic gas-liquid mixture at a first pressure and an expansion nozzle. The nozzle, is provided with at least one exit opening which allows passage of the mixture therethrough. The nozzle is connected to a delivery line for receiving the cryogenic gas-liquid mixture and for expanding the mixture from the first pressure to a second pressure lower than the first pressure, thereby producing aerosol. A separator is coupled to the nozzle, such that the cryogenic clusters and the light particles with high mobility are removed from the stream, thereby producing a stream of cryogenic particle flow with controlled size to clean a contaminated surface. The apparatus is enhanced by utilizing magnetic field and/or specially designed flow field to fully take advantage of the enhanced mobilities of light particles.

BRIEF DESCRIPTION OF THE DRAWINGS

These and other objects, features, aspects and advantages of the apparatus will be more readily apparent and better understood from the following detailed description of the invention, in which.

DETAILED DESCRIPTION OF THE PREFERRED EMBODIMENT

Figure 1:
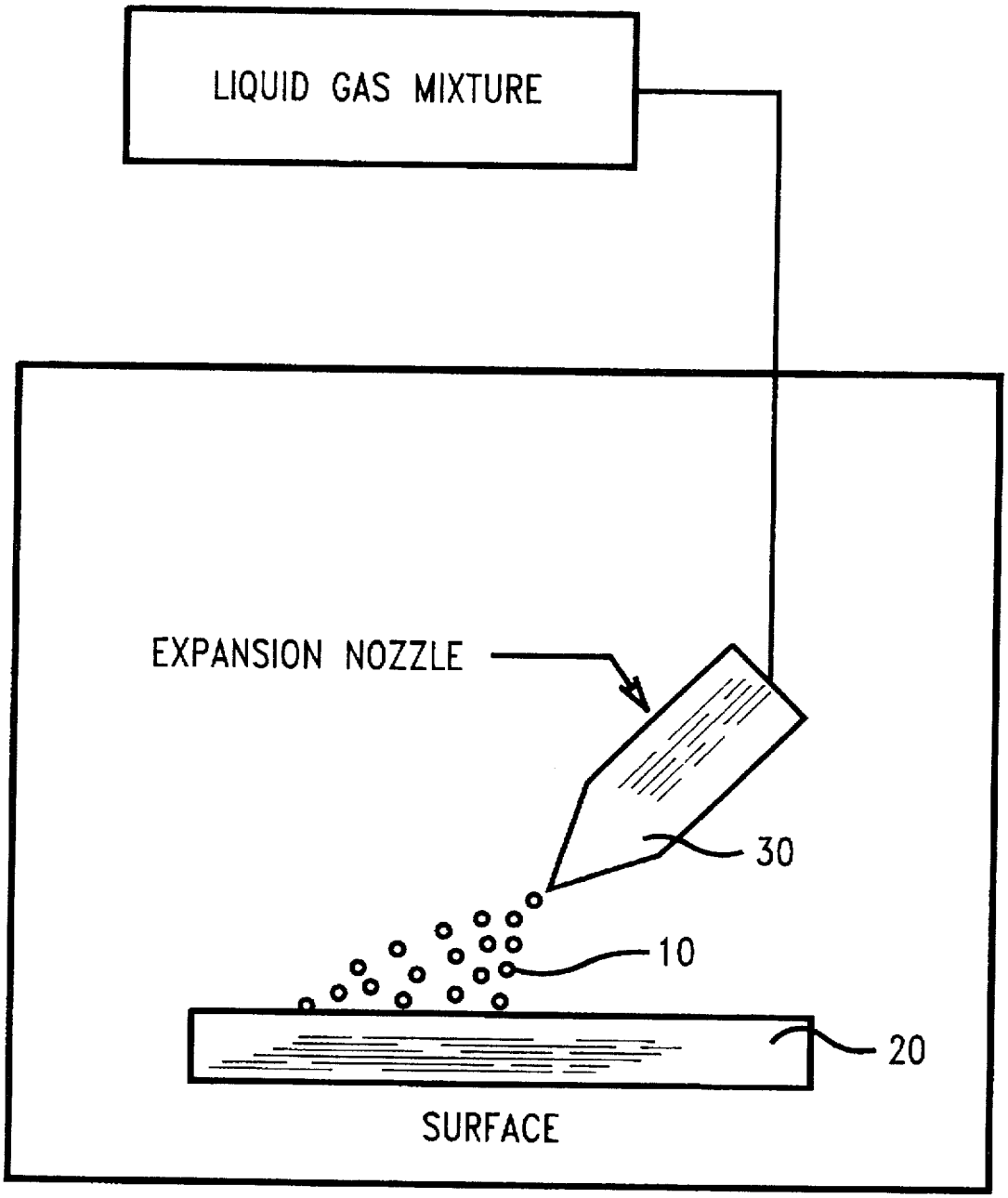
FIG. 1 (Prior Art)
FIG. 1 is a schematic diagram of a prior art cryogenic aerosol generator showing an aerosol jet stream impinging on a surface.
Figure 2:
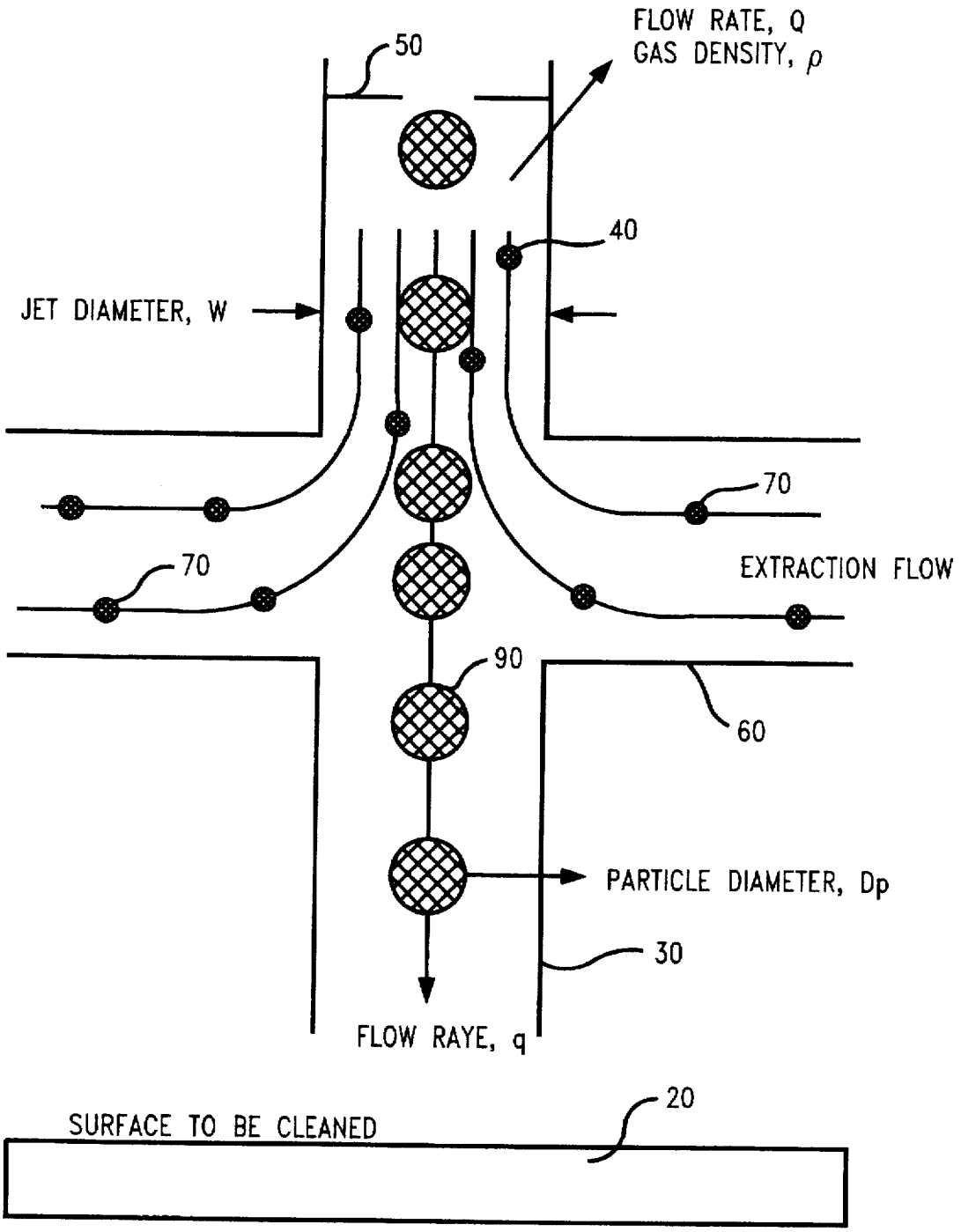
FIG. 2 is a schematic diagram of a cryogenic aerosol separator showing how large and small particles are segregated from each other, in accordance with the present invention.

With reference to the drawings, wherein the same reference numbers indicate the same elements throughout, there is shown in FIG. 2 a schematic diagram of a cryogenic separator illustrating the various structural and operational features that form the essence of the present invention.

Generally, a cryogenic aerosol separator is formed to minimize the temperature cooling on the surface of, e.g., a substrate, an X-ray mask, and the like, by separating the solid particles inertially from the main gas stream.

The cryogenic aerosol is formed downstream of the expansion orifice carrying a gas having a flow rate Q and density ρ. The extraction flow makes a sharp turn to a side passage 60 to capture and remove the majority of the gas molecules, clusters, and small particles 70 from the main stream 40 through the use of vacuum. Small particles, which are most likely to vaporize during the surface cleaning process will, in this manner, be diverted to the side passage 60. On the other hand, cryogenic particles 90 with a size larger than $D_p$ will continue moving downward.

The impact of gas molecules on the surface 20 causes the surface temperature to drop. Without the separator, this rate is:

$$\rho Q+\rho_s vQ \tag{1}$$

wherein $\rho_s$ and v represent, respectively, the density and the volume fraction of the small cryogenic particles. With the separator, the rate of gas molecules impacting on the surface is:

$$\rho q, \tag{2}$$

wherein q is the reduced gas flow rate carrying the large cryogenic particles. The improvement of the temperature cooling is expected to be proportional to the reduction of the rate of the gas molecules impacting the surface. The improvement factor can be estimated as:

$$\frac{\rho Q+\rho_s vQ}{\rho q}=\frac{Q}{q}\left(1+\frac{\rho_s}{\rho}v\right) \tag{3}$$

The improvement factor can easily be 1000 times or more for v and q/Q, both being 10%.

When a particle with diameter $D_p$ and with an initial velocity $V_o$ is projected into an almost stationary air column, it will travel a finite distance before coming to rest. This distance is given by:

$$s=\frac{\rho_s D_p^2 V_0}{18\mu}, \tag{4}$$

wherein μ is the gas viscosity. The separation particle diameter $D_p$ can be determined if its stopping distance s is farther than half the jet diameter, i.e., W/2.

A set of design criteria can be determined to relate the separation particle diameter to the process parameters with the assumption that s=W/2:

$$QD^2_p=300\ W^3, \tag{5}$$

wherein the units of Q, $D_p$, and W are $ft^3$/min, μm, and cm, respectively.

By way of example, if a 0.25 cm jet (W) is used, the size of the separated particles for surface cleaning can be selected by adjusting the gas flow rate Q. Typical numerical values are shown in the table hereinbelow:

| Q(cfm) | $D_p$(μm) |
|---|---|
| 0.05 | 10 |
| 0.19 | 5 |
| 1.13 | 2 |

The cryogenic aerosol size distribution downstream of the expansion orifice within the separator is expected to shift somewhat to a larger size due to the additional vacuum provided downstream of the orifice. The fraction of solids in the two phase flow within the separator is expected to be higher than the free expansion to the air.

Figure 3:
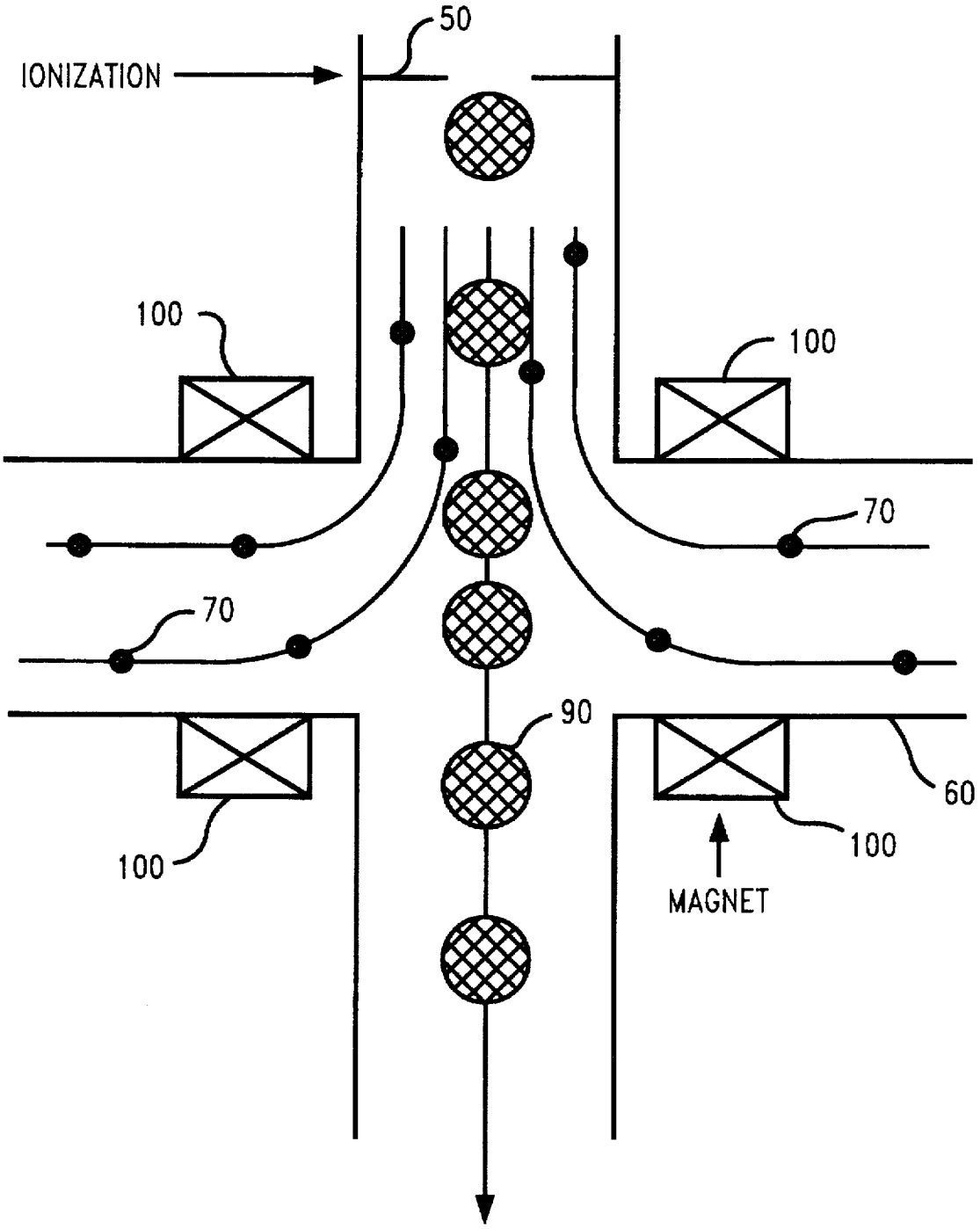
FIG. 3 illustrates a second embodiment of the cryogenic aerosol separator in accordance with the present invention.

The separation of the clusters and/or small particles to the side passage are expected to be less than perfect, since the particle size distribution is not uniform across the jet stream of the expansion nozzle. The separation behavior can be enhanced by utilizing the fact that the electrical and/or magnetic mobility of particles increases as the size of the particles decreases. Shown in FIG. 3 are means for increasing the mobility of the small particles to the side passages by first introducing charges on the particles. This step is achieved by placing a set of magnets 100 around the periphery of the side passage 60.

The electrical charge associated with the particles comprising the aerosol can be enhanced by ionization. Particles having a lower mass/charge ratio will be deflected more than those having a higher mass/charge ratio in the magnetic field created by the presence of the magnets 100, leading to a more efficient extraction and classification of particles according to their mass/charge ratio.

Figure 4:
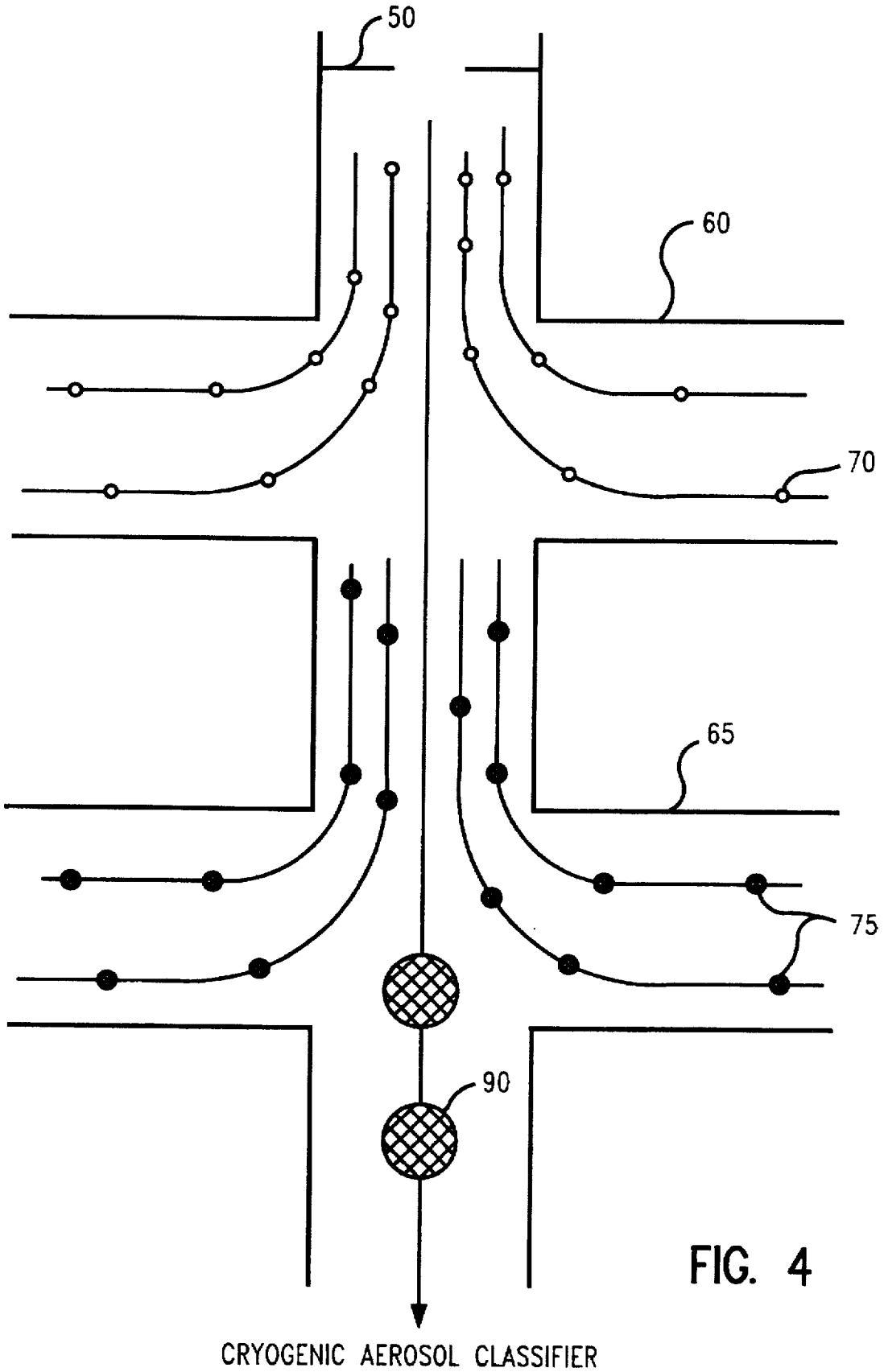
FIG. 4 shows yet another embodiment of the present invention, wherein particles are classified in accordance to their respective size and/or mass.

FIG. 4 shows a schematic diagram that illustrates the aforementioned inertial separation phenomenon in stages (60 and 65) which leads to the establishment of a cryogenic aerosol classifier, wherein uniform-sized cryogenic particles 70 and 75 can be produced, and extracted from the mainstream particles 90.

The physical design of the separator may vary due to other limitations involved in the layout. The aforementioned embodiments have been used to describe the principle of the inertial separation. Practitioners of the art will readily appreciate that other variations, such as, e.g., selecting the small particles and "discarding" the large particles from the aerosol, may be successfully implemented provided the same physical principle applies.

Figure 5A:
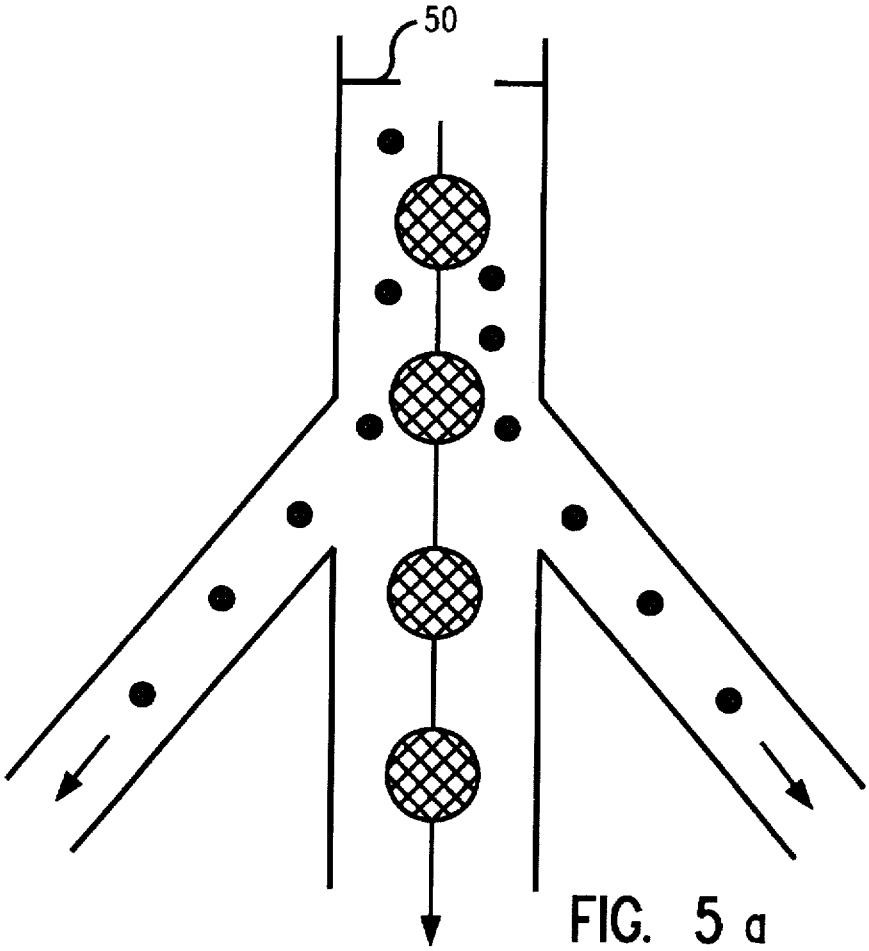
FIGS. 5a–5b show a cross-sectional and top view of the separator surrounding the jet nozzle.
Figure 5B:
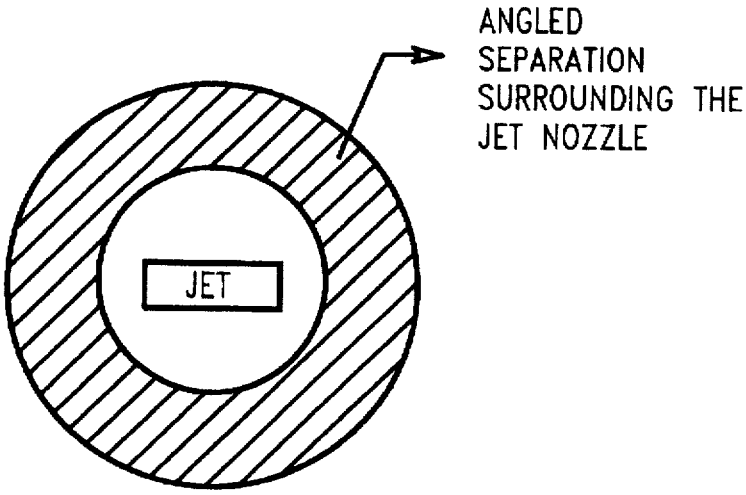

Referring now to FIGS. 5a–5b, there is shown another embodiment to provide a more efficient separation by attaching the extraction separator at an angle and surrounding the nozzle (FIG. 5b). The angled design (FIG. 5a) improves the separation efficiency, since the particles trajectory does not have to be altered to the extent described in the embodiment shown in FIG. 2.

Figure 6A:
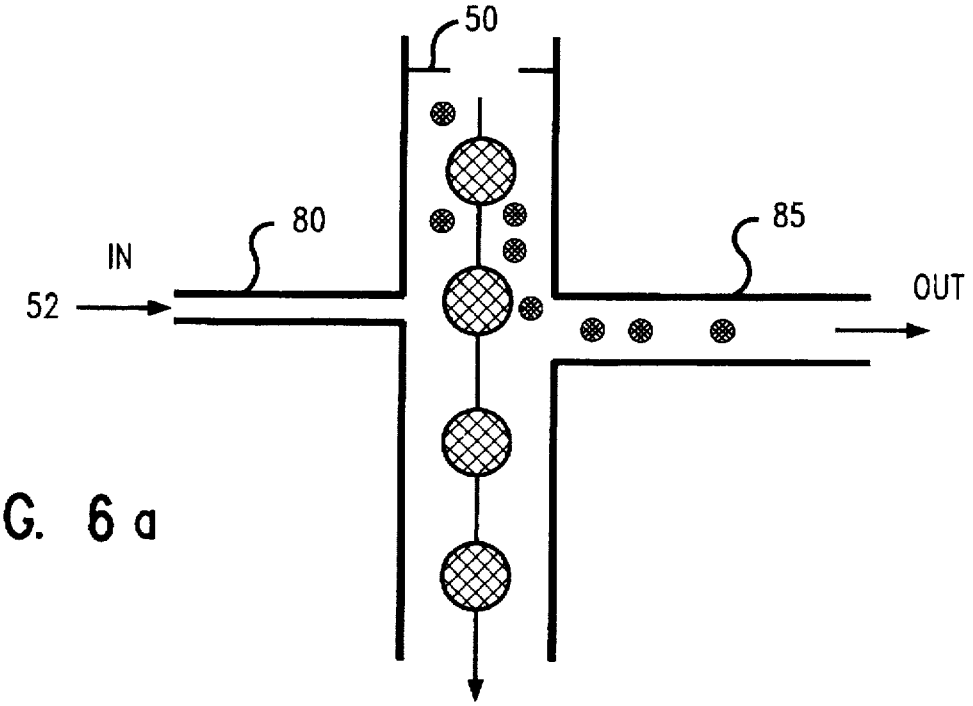
FIGS. 6a–6c illustrate a cross-sectional and a top view of a "gas curtain" embodiment of the separator, in accordance with the present invention.
Figure 6B:
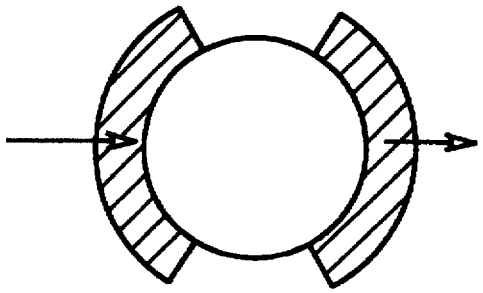
Figure 6C:
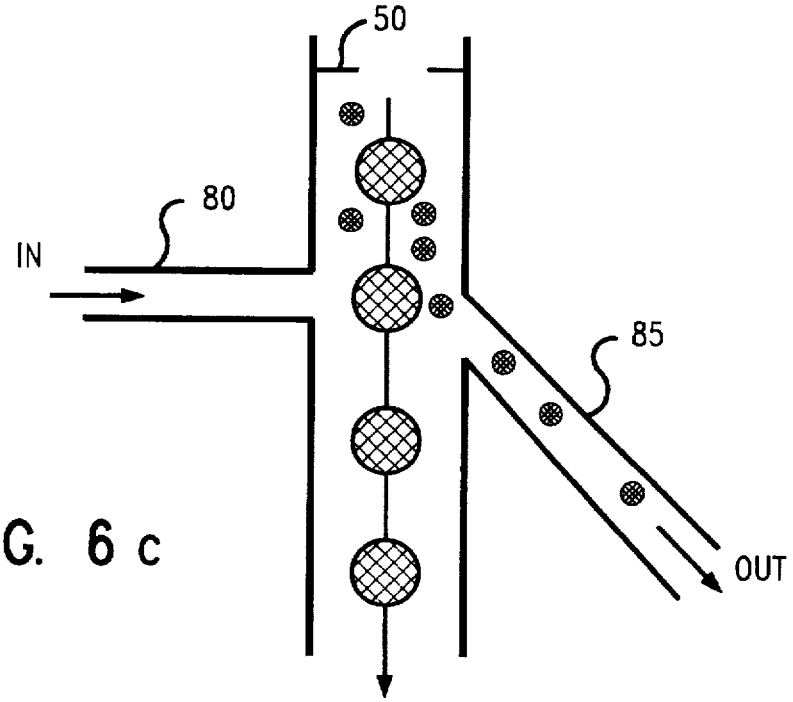

In yet another embodiment directed to an extraction method based on a separation effect will be described hereinafter. This method, to be referred as a "gas curtain", is used to remove smaller particles from the aerosol. FIGS. 6a–6c show several schematic views illustrating this method. An additional gas flow S2, (which may be the same as the aerosol source gas), is introduced through an inlet located on one side of the expansion nozzle. An outlet 85 on the opposite side and downstream from inlet 80 is positioned such that it maintains an optimum collection rate of smaller particles from the aerosol stream as they are swept out of the main stream by the gas flow S2. The size of the inlet 80 and of the outlet 85 openings can be calculated from fluid mechanic considerations to determine the selected particle size intended for separation. The gas flow S2 exiting inlet 80 deflects aerosol particles having higher mobility from the mainstream flow 40 into outlet 85. The "gas curtain" effect is achieved by establishing a gas flow S2 across (preferably, in a direction perpendicular) to the main flow 40. The force of the gas flow S2 deflects the smaller particles, (i.e., with higher mobility) from the main flow 40 into outlet 85. The advantage of this alternate method is a better control over the pressure on the downstream side of the nozzle, while removing the smaller particles in a "sweeping" action. While the invention has been particularly shown and described with reference to preferred embodiments thereof, it will be understood by those skilled in the art that various changes and modifications in form and detail may be made therein without departing from the spirit and scope of the invention.

What is claimed is:

1. A cryogenic aerosol classifier for inertially separating and classifying particles from a stream of aerosol, comprising:

cryogenic aerosol generating means for expanding a cryogenic gas-liquid mixture at a first pressure to a second pressure lower than said first pressure, thereby generating a stream of aerosol having high and low mobility particles; and separator means provided with a diverter coupled to said cryogenic aerosol generating means for removing and diverting particles having high mobility from said stream of aerosol.

2. The cryogenic aerosol classifier according to claim 1, wherein said cryogenic aerosol comprises particles of different sizes.

3. The cryogenic aerosol classifier according to claim 1, wherein said cryogenic aerosol comprises small and large cryogenic particles, said separator means removing said small cryogenic particles from said large cryogenic particles.

4. The cryogenic aerosol classifier according to claim 3, wherein the mass flow rate of the gas stream carrying said large particles is given by the equation $\rho q$, with $\rho$ being the gas density and q, the reduced gas flow rate carrying said large particles.

5. The cryogenic aerosol classifier according to claim 3, wherein said separator means comprises a vacuum for separating said small particles.

6. The cryogenic aerosol classifier according to claim 3, wherein said diverter comprises at least one side passage integral to said nozzle.

7. The cryogenic aerosol classifier according to claim 3, further comprising a plurality of side passages connected at periodic intervals of said separator means to classify said cryogenic aerosol in accordance to the size and the mobility of said particles comprising said aerosol.

8. The cryogenic aerosol classifier according to claim 1, further comprising magnetic means surrounding the periphery of said separator means for increasing the mobility of said particles having high mobility.

9. The cryogenic aerosol classifier according to claim 8, wherein said magnetic means deflect particles having a lower mass/charge ratio to a greater extent than particles having a higher mass/charge ratio.

10. The cryogenic aerosol classifier according to claim 1, wherein said cryogenic gas-liquid mixture is selected from the group consisting of carbon dioxide, argon, nitrogen and mixtures thereof.

11. The cryogenic aerosol classifier according to claim 1, further comprising a reservoir wherein said gas-liquid mixture is maintained at cryogenic temperature.

12. The cryogenic aerosol classifier according to claim 1, further comprising a cross-stream gas flow into an outlet positioned downstream from said nozzle to divert said particles of high mobility from said stream of aerosol.

13. The cryogenic aerosol classifier according to claim 12, wherein said outlet is positioned opposite to an inlet carrying said cross-stream gas.

14. A cryogenic aerosol classifier for inertially separating and classifying particles from a stream of aerosol, comprising:

a cryogenic aerosol generator comprising a reservoir containing a cryogenic gas-liquid mixture at a first pressure, a delivery line coupled to said reservoir, and a nozzle connected to said delivery line for expanding said mixture from said first pressure to a second pressure lower than said first pressure for producing a cryogenic aerosol having high and low mobility particles; and separator means provided with a diverter, said separator means being coupled to said nozzle, wherein particles having high mobility are removed and diverted from said stream.

15. The cryogenic aerosol classifier according to claim 14, wherein said diverter comprises at least one side passage integral to said nozzle.

16. The cryogenic aerosol classifier according to claim 14, wherein said separator means comprises a vacuum for separating said high mobility particles.

17. The cryogenic aerosol classifier according to claim 14, further comprising a plurality of side passages connected at periodic intervals of said nozzle to classify said cryogenic particles in accordance to their size and their mobility.

18. The cryogenic aerosol classifier according to claim 14, further comprising a heat exchanger coupled to said reservoir and to said nozzle for receiving and cooling said gas-liquid mixture or gas to a cryogenic temperature.

19. A method for separating and classifying cryogenic aerosol particles having different mobility, comprising the steps of:

generating an aerosol having high and low mobility particles by moving a cryogenic gas-liquid mixture from an area at a first pressure into an area at a second pressure which is lower than said first pressure; and providing a separator having a diverter to separate from said aerosol particles having high mobility from particles having a low mobility.

20. The method according to claim 19, wherein said separator means comprises a vacuum for separating said high mobility particles.

21. The method according to claim 19, wherein said separator comprises at least one side passage.

22. The method according to claim 19, wherein said separator further comprising a plurality of side passages connected at periodic intervals to classify said aerosol in accordance to the size and the mobility of said particles comprising said aerosol.

23. The method according to claim 19, further comprising magnetic means surrounding the periphery of said separator for increasing the mobility of said particles having high mobility.

24. The method according to claim 23, wherein said magnetic means deflect particles having a lower mass/charge ratio to a greater extent than particles having a higher mass/charge ratio.

25. The method according to claim 19, wherein said cryogenic gas-liquid mixture is selected from the group consisting of carbon dioxide, argon, nitrogen and mixtures thereof.

26. The cryogenic aerosol classifier according to claim 19, further comprising a reservoir wherein said gas-liquid mixture is maintained at cryogenic temperature.

27. A method for separating and classifying cryogenic aerosol, said aerosol having particles with different mobility, said method comprising the steps of:

generating aerosol by moving a cryogenic gas-liquid mixture from a reservoir to a delivery line, wherein said delivery line is at a first pressure;

moving said mixture from said delivery line through a nozzle into an expansion area such that said mixture is at a second pressure which is lower than said first pressure, thereby creating aerosol particles having particles with different mobility;

providing a separator having a diverter coupled to said expansion area for separating the aerosol particles having high mobility from particles having a low mobility; and diverting said particles having high mobility from said expansion area into an outlet, wherein said outlet is at a third pressure which is lower than said second pressure.

28. The method according to claim 27, wherein said third pressure is vacuum.

29. The method according to claim 27, further comprising a cross-stream gas flow into an outlet positioned downstream from said nozzle to divert said particles of high mobility from said stream of aerosol.

* * * * *